United States Patent [19]

Baggio

[11] Patent Number: 4,760,653

[45] Date of Patent: Aug. 2, 1988

[54] DEVICE FOR CLOSING THE QUARTERS OF SKI BOOTS

[75] Inventor: Giorgio Baggio, S. Martino Di Lupari, Italy

[73] Assignee: Nordica SpA, Montebelluna, Italy

[21] Appl. No.: 936,864

[22] Filed: Dec. 1, 1986

[30] Foreign Application Priority Data

Dec. 24, 1985 [IT] Italy ..... 24249/85[U]

[51] Int. Cl.[4] ..... A43B 5/04; A43C 11/00

[52] U.S. Cl. ..... 36/117; 36/50; 24/68 SK; 24/71.2

[58] Field of Search ..... 36/117–121, 36/50, 105; 24/68 SK, 68 B, 71.2, 71.1

[56] References Cited

U.S. PATENT DOCUMENTS

| | | | |
|---|---|---|---|
| 4,571,855 | 2/1986 | Blanc | 36/50 |
| 4,633,599 | 1/1987 | Morell et al. | 36/50 |
| 4,653,204 | 3/1987 | Morell et al. | 36/117 |
| 4,691,454 | 9/1987 | Ottieri | 36/117 |

FOREIGN PATENT DOCUMENTS

| | | | |
|---|---|---|---|
| 0053340 | 6/1982 | European Pat. Off. | 36/120 |
| 3506057 | 2/1986 | Fed. Rep. of Germany | 36/117 |
| 979790 | 12/1950 | France | 36/117 |
| 2570257 | 3/1986 | France | 36/119 |

*Primary Examiner*—James Kee Chi

*Attorney, Agent, or Firm*—Guido Modiano; Albert Josif

[57] ABSTRACT

The device comprises a lever, pivotally coupled at its upper end to a ski boot rear quarter, adapted for entraining a cable. The cable is arranged for interconnecting the front and rear quarters of a ski boot in two separate zones, spaced apart from each other along the longitudinal extension of the quarters.

20 Claims, 2 Drawing Sheets

DEVICE FOR CLOSING THE QUARTERS OF SKI BOOTS

BACKGROUND OF THE INVENTION

The present invention relates to a device for closing the quarters of ski boots, particularly of the rear-entry type.

As is known, to perform the closing of the quarters of rear-entry ski boots, levers are currently employed which are supported, e.g., by the front quarter and which rearwardly encircle the rear quarter to perform the closing on the other side of the front quarter.

This kind of solution has the disadvantage that, during the opening of the boot, it gives rise to a separation of the elements which provide the closing action.

Other known solutions entail the use of spools or the like which act on a cable which interconnects the quarters to each other, generally proximate to their upper end.

This kind of solution, though it has proved to be valid from several viewpoints, has the disadvantage of not locking the quarters completely to each other for their entire longitudinal extension, with the possibility of unwanted splaying out in the case of a forward flexing action while skiing.

Furthermore, other known solutions require the exertion of severe efforts on the closing device, so as to achieve the desired reciprocal locking force between the quarters.

SUMMARY OF THE INVENTION

The aim proposed by the invention is to provide a new type of device for closing the quarters of ski boots, which allows the possibility of achieving a complete opening of the rear quarter, thus simplifying the introduction of the foot, without however giving rise to a separation of the elements which perform the closing action.

Within the scope of the above described aim, a particular object of the invention is to provide a closing device wherein it is possible to achieve the locking of the quarters in a plurality of longitudinally separated points, thus avoiding the risk of splaying out of the quarters during the flexing of the quarters relatively to the base.

Still another object of the present invention is to provide a closing device which allows the possibility of achieving a high reciprocal locking force between the quarters, without thereby requiring particular efforts on the part of the user.

The above described aim, as well as the objects described and others which will better appear hereinafter, are achieved by a device for closing the quarters of ski boots, according to the invention, characterized in that it comprises a recovery apparatus for at least one cable supported by the rear quarter, said cable interconnecting to each other the quarters in two separate zones spaced apart from each other along the longitudinal extension of said quarters.

BRIEF DESCRIPTION OF THE DRAWINGS

Further characteristics and advantages will become apparent from the detailed description of a device for closing the quarters of ski boots, illustrated by way of example only in the accompanying drawings, wherein.

DESCRIPTION OF THE PREFERRED EMBODIMENTS

Figure 1:
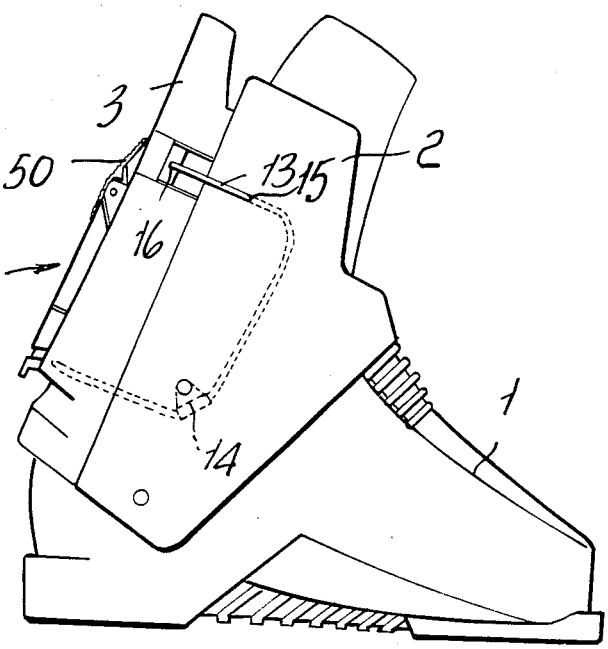
FIG. 1 is a schematic lateral elevation view of the closing device, according to the invention, applied to a ski boot.
Figure 3:
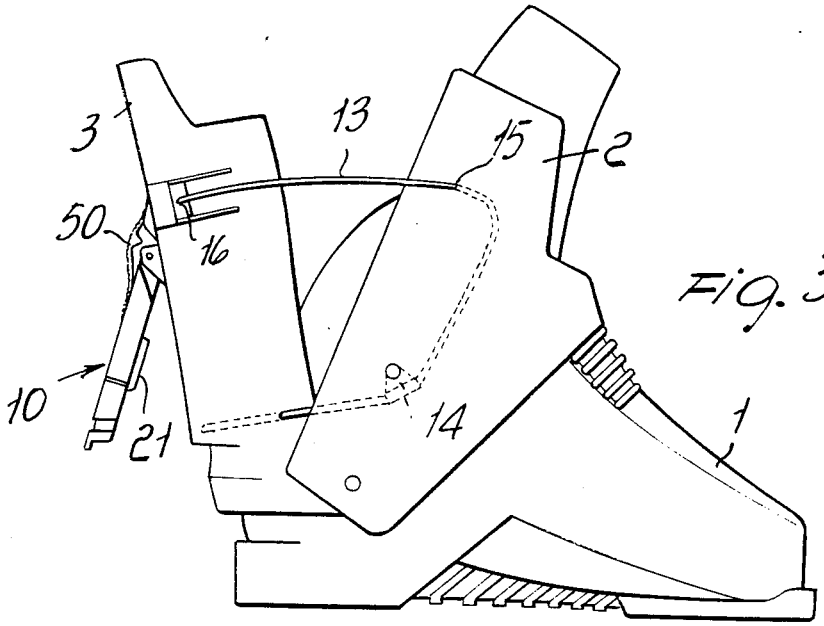
FIG. 3 is a lateral elevation view of the ski boot in open position.
Figure 2:
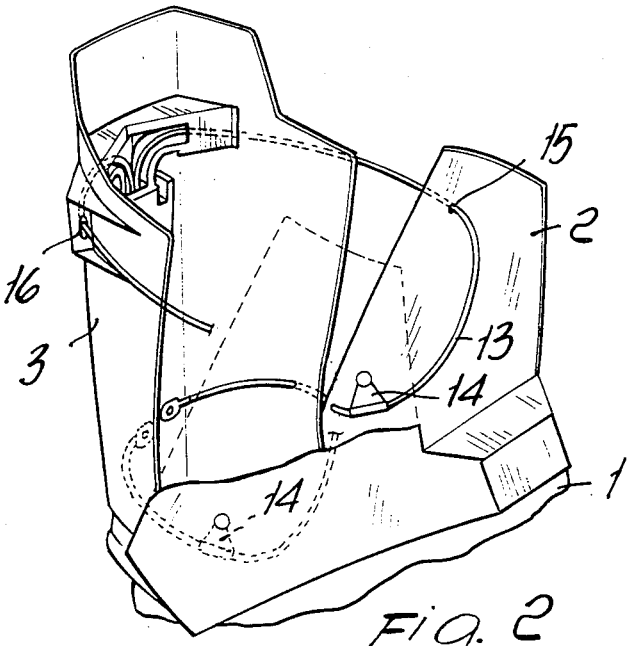
FIG. 2 is a perspective view of the closing device in a partially open position.
Figure 5:
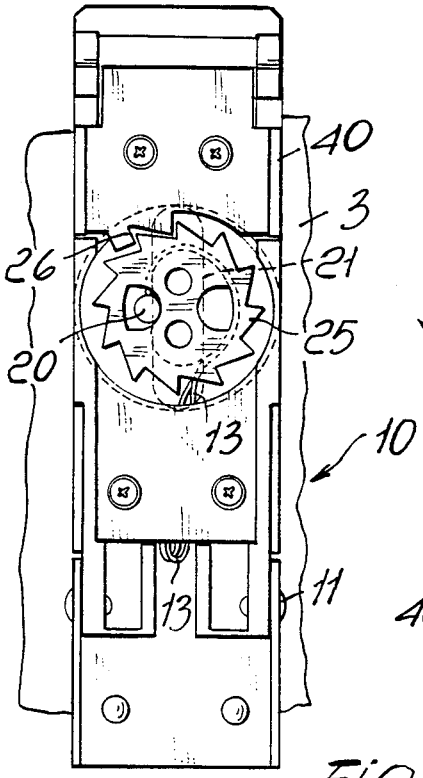
FIG. 5 is a partial cross section view of the cable recovery apparatus.

With reference to the above described figures, a rear-entry ski boot is illustrated, which, in a per se known manner, has a shell 1 to which are movably coupled a front quarter 2 and a rear quarter 3.

On the rear quarter 3 a cable recovery apparatus is provided which is composed of a locking lever 10, pivoted at its upper end to lugs 11 fixed at the top end of the rear quarter.

The lever 10 supports a spool, indicated by the reference numeral 12, for recovering a cable 13 which brings the quarters 2 and 3 together.

More in detail, the cable 13 has its ends fixed to the lower part of the rear quarter.

The cable 13 forms loops 14 provided laterally proximate to a lower region of the front quarter 2 and then extends inside the front quarter up to upper lateral holes, indicated by the reference numeral 15, from which the cable emerges and connects the rear quarter until it enters in inlet holes 16 provided on the rear quarter above the pivoting region of the lever 10.

With the above described arrangement, the cable 13 brings the quarters together in two separate regions, spaced apart along the longitudinal extension of the same quarters, so that the quarters are brought together in two points which allow to obtain a precise reciprocal locking.

Furthermore, the presence of the connection proximate to the lower part of the quarters allows to avoid the splaying out during the flexing exerted on the quarters relatively to the base while skiing.

The cable 13, in a middle portion thereof, is connected to a pawl 20, fixed to the winding spool 12, which is operatable by means of a knob 21 provided on the lever 10, on the face thereof which remains facing the boot with the lever in a closed position.

A saw-toothed crown 25 is rigidly associated with the spool 12, and couples with a matching counter toothing 26 provided on a small plate, rigidly associated with a slider 40 slideably supported by the lever itself, with the interposition of elastic biasing means, which, in the illustrated example comprise springs 41.

The matching counter toothing 26 is intended to prevent rotation of the saw-toothed crown 25 in the direction of unwinding of the cable, and it has a ratchet-like engagement when the saw-toothed crown is rotated in the direction of winding of the cable, i.e.during the recovery of the cable on the lever.

To perform the loosening of the cable, it is sufficient to act on the slider 40, which supports the small plate which accommodates the matching counter toothing 26 against the elastic biasing action exerted by the springs 41, to obtain uncoupling of the toothing 26 from the saw-toothed crown 25 and the consequent free unwinding of the cable from the spool.

In practice, the presence of a recoverable cable with spool, which brings the two quarters together, allows the possibility of performing a wide opening of the rear quarter 3 to simplify the insertion of the foot and then, by raising the lever 10, it is possible, by means of the knob 21, to recover, without particular effort, the cable, thus obtaining a reciprocal motion bringing the quarters towards each other.

The locking is achieved by acting on the lever which tensions the cables and which, in a closed position, is arranged facing the rear part of the quarter.

Figure 4:
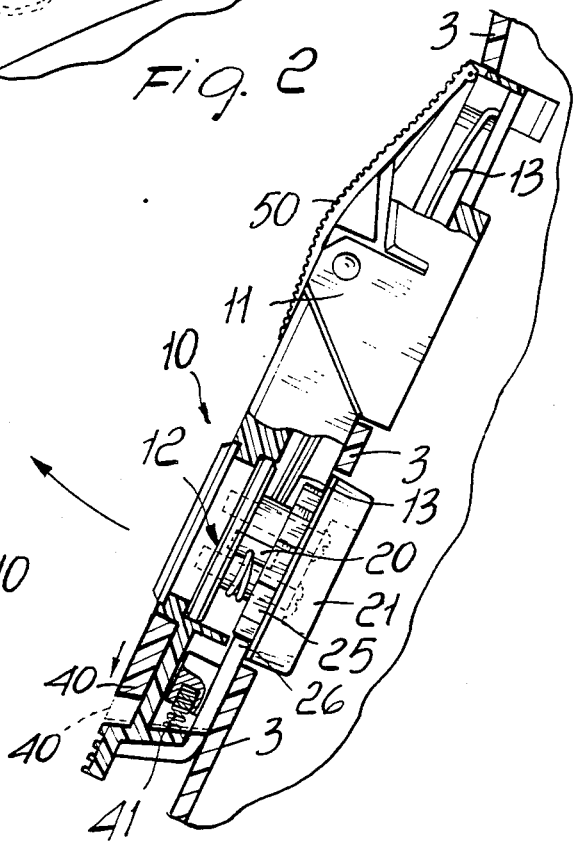
FIG. 4 is a lateral elevation view of the recovery apparatus for the cable provided on the rear quarter.

It should furthermore be added that, as is illustrated in FIG. 4, with the lever in closed position the cable 13 passes below the pivoting pin of the same lever, so that it is the tension of the cable itself that keeps the lever in closed position, preventing its accidental opening.

To open the quarters, it is sufficient, initially, to open the lever, thus causing a first loosening of the cable, and subsequently by acting on the slider, to uncouple the matching arrangement of toothing 26 from the saw-toothed crown 25, thus allowing the free unwinding of the cable and the consequent opening of the quarters.

For the sake of completeness, it should be furthermore added that a covering band 50 is provided, which is interconnected between the lever and the rear quarter, so that it conceals the region in which the cable is inserted into the boot.

From what has been described, it can be seen that the device achieves the aim proposed and in particular the fact is stressed that a closing device is provided which is substantially composed of a single lever provided on the rear quarter, which is provided with a takeup spool for a notable amount of cable, so that the quarters can be moved sufficiently apart without however producing an uncoupling of the closing elements.

Another important feature of the invention is furthermore constituted by the fact that the cable performs the closing of the quarters in two points spaced apart along the longitudinal extension of the same quarters, so that a uniform locking action is obtained along the entire length of the quarters, thus preventing the occurrence of any splaying out and the like.

Practically the materials employed, so long as compatible with the specific use, as well as the dimensions and the contingent shapes, can be any according to the requirements.

I claim:

1. In combination, a ski boot and a device for closing the quarters of said ski boot, said ski boot comprising a shell, and quarters including a front quarter and a rear quarter, said front quarter and said rear quarter being pivotally connected to said shell, said quarters each defining a longitudinal extension, said device for closing said quarters of said ski boot comprising a recovery apparatus including at least one recovery spool, at least one cable, at least one lever having an upper end, at least one saw toothed crown, at least one plate defining a counter toothing, comprising a recovery apparatus including at least one recovery spool,at least one slider, elastic biasing means, said recovery apparatus being supported by said rear quarter and adapted for recovering at least a portion of said at least one cable, said cable interconnecting said front quarter and said rear quarter in at least two separate zones, said separate zones being spaced apart from each other along said longitudinal extension of said quarters, said upper end of said lever being pivotally coupled to said rear quarter and adapted for supporting said recovery spool, said saw-toothed crown being rigidly associated with said recovery spool and engaging said counter toothing defined on said plate, said plate being supported by said slider, said slider being slideably mounted on said lever, said elastic biasing means being interposed between said slider and said lever, said recovery spool being adapted for winding said cable on and unwinding said cable from said spool, said cable defining a winding direction and an unwinding direction, said counter toothing being adapted for engagement with said said saw-toothed crown to removably prevent rotation of said spool in said unwinding direction defined by said cable, and for ratchet-like engagement with said saw-toothed crown during rotation of said spool in said winding direction defined by said cable.

2. A combination according to claim 1, wherein said elastic biasing means comprise a plurality of springs, interposed between said slider and said lever.

3. A combination according to claim 1, wherein said elastic biasing means are adapted for exerting an elastic biasing force between said slider an said lever, and wherein said recovery apparatus is adapted for permitting unwinding of said at least one cable from said spool upon selectively moving said slider on said lever against said elastic biasing force exerted by said elastic biasing means, thereby causing disengagement of said counter toothing from said saw tooth crown.

4. A combination according to claim 1, said cable has at least one end and at least one other end, and wherein said front quarter defines an inside face and has formed therein upper lateral holes, said rear quarter defining a lower part and having at least one inlet hole, said at least one end of said cable being fixed to said lower part of said rear quarter, said cable extending from said lower part of said rear quarter to said inside face of said front quarter, said combination further comprising guide means, said guide means being attached to said inside face of said front quarter and adapted for guiding said cable towards at least one of said upper lateral holes, said cable extending around said guide means, exiting said front quarter through one of said upper lateral holes, and entering said rear quarter through said inlet hole, said at least one other end of said cable being rigidly associated with said recovery means supported by said rear quarter.

5. A combination according to claim 1, wherein said recovery apparatus further comprises at least one knob, said knob being adapted for operating said spool for recovering said cable by causing ratchet-like interference between said toothed crown and said counter toothing.

6. A combination according to claim 1, wherein said recovery apparatus further comprises at least one knob, said knob being adapted for operating said spool for recovering said cable by causing ratchet-like interference between said toothed crown and said counter toothing, said knob being rotatably mounted on said lever and arranged facing said rear quarter of said ski boot.

7. In combination, a ski boot and a device for closing the quarters of said ski boot, said ski boot comprising a shell, and quarters including a front quarter and a rear quarter, said front quarter and said rear quarter being connected to said shell, said quarters each defining a longitudinal extension, said device for closing said quarters of said ski boot comprising a recovery means, at least one cable, at least one lever having an end, at least one ratchet means including, at least one plate, and at least one slider, and elastic biasing means, said recovery means being supported by said rear quarter and adapted for recovering at least a portion of said at least one cable, said cable interconnecting said front quarter and said rear quarter in at least two seperate zones, said seperate zones being spaced apart from each other along said longitudinal extension of said quarters, said end of said lever being pivotally coupled to said rear quarter and adapted for supporting said recovery means, said ratchet means being rigidly associated with said recovery means and adapted for co-operation with said plate, said plate being supported by said slider, said slider being slideably mounted on said lever, said elastic biasing means being interposed between said slider and said lever, said recovery means being adapted for winding and unwinding said cable, said cable defining a winding direction and an unwinding direction, said ratchet means being adapted to selectively prevent actuation of said recovery means in said unwinding direction defined by said cable and for ratchet-like operation during rotation of said recovery means in said winding direction defined by said cable.

8. A combination according to claim 7 wherein said recovery means comprises a recovery apparatus including at least one recovery spool, and wherein said ratchet means comprise at least one saw toothed crown and at least one counter toothing, said counter toothing being formed on said plate, said saw toothed crown being rigidly associated with said spool, said spool being rotatably supported by said rear quarter, said lever being pivotally attached to said rear quarter, said plate being supported by said slider, said slider being slideably mounted on said lever and adapted for permitting said counter toothing to engage with said saw toothed crown.

9. A combination according to claim 8, wherein said elastic biasing means comprise a plurality of springs, interposed between said slider and said lever.

10. A combination according to claim 8, wherein said elastic biasing means are adapted for exerting an elastic biasing force between said slider an said lever, and wherein said recovery apparatus is adapted for permitting unwinding of said at least one cable from said spool upon selectively moving said slider on said lever against said elastic biasing force exerted by said elastic biasing means, thereby causing disengagement of said counter toothing from said saw tooth crown.

11. A combination according to claim 7, said cable has at least one end and at least one other end, and wherein said front quarter defines an inside face and has formed therein upper lateral holes, said rear quarter defining a lower part and having at least one inlet hole, said at least one end of said cable being fixed to said lower part of said rear quarter, said cable extending from said lower part of said rear quarter to said inside face of said front quarter, said combination further comprising guide means, said guide means being attached to said inside face of said front quarter and adapted for guiding said cable towards at least one of said upper lateral holes, said cable extending around said guide means, exiting said front quarter through one of said upper lateral holes, and exerting said rear quarter through said inlet hole, said at least one other end of said cable being rigidly associated with said recovery means supported by said rear quarter.

12. A combination according to claim 8, wherein said recovery apparatus further comprises at least one knob, said knob being adapted for operating said spool for recovering said cable by causing ratchet-like interference between said toothed crown and said counter toothing.

13. A combination according to claim 8, wherein said recovery apparatus further comprises at least one knob, said knob being adapted for operating said spool for recovering said cable by causing ratchet-like interference between said toothed crown and said counter toothing, said knob being rotatably mounted on said lever and arranged facing said rear quarter of said ski boot.

14. In combination, a ski boot and a device for closing the quarters of said ski boot, said ski boot comprising a shell, and quarters including a front quarter and a rear quarter, said front quarter and said rear quarter being connected to said shell, said quarters each defining a longitudinal extension, said device for closing said quarters of said ski boot comprising a cable recovery means, and at least one cable, said recovery means being supported by one of said quarters and adapted for recovering at least a portion of said at least one cable, said cable interconnecting said front quarter and said rear quarter in at least two seperate zones, said seperate zones being spaced apart from each other along said longitudinal extension of said quarter, said recovery means comprising a recovery apparatus including at least one recovery spool ratchet means, and actuation means including at least one lever, and wherein said ratchet means comprise at least one saw toothed crown, at least one plate, at least one slider, elastic biasing means, and at least one counter toothing, said plate being supported by said slider, said slider being slideably mounted on said lever, said elastic biasing means being interposed between said slider and said lever said counter toothing being formed on said plate, said saw toothed crown being rigidly associated with said spool, said spool being rotatably supported by said rear quarter, said lever being pivotally attached to said rear quarter, said plate being supported by said slider, said slider being slideably mounted on said lever and adapted for permitting said counter toothing to engage with said saw toothed crown.

15. A combination according to claim 14, wherein said recovery means comprises a recovery apparatus including at least one recovery spool, wherein said actuation means comprises at least one lever having an end and wherein said recovery means comprise ratchet means including at least one saw toothed crown, at least one plate, at least one slider, elastic biasing means, and at least one counter toothing.

16. A combination according to claim 15, wherein said plate is supported by said slider, said slider being slideably mounted on said lever, said elastic biasing means being interposed between said slider and said lever said counter toothing being formed on said plate, said saw toothed crown being rigidly associated with said spool, said spool being rotatably supported by said rear quarter, said lever being pivotally attached to said rear quarter, said plate being supported by said slider, said slider being slideably mounted on said lever and adapted for permitting said counter toothing to engage with said saw toothed crown.

17. A combination according to claim 15, wherein said elastic biasing means comprise a plurality of springs, interposed between said slider and said lever.

18. A combination according to claim 15, wherein said elastic biasing means are adapted for exerting an elastic biasing force between said slider an said lever, and wherein said recovery apparatus is adapted for permitting unwinding of said at least one cable from said spool upon selectively moving said slider on said lever against said elastic biasing force exerted by said elastic biasing means, thereby causing disengagement of said counter toothing from said saw tooth crown.

19. A combination according to claim 15, wherein said recovery apparatus further comprises at least one knob, said knob being adapted for operating said spool for recovering said cable by causing ratchet-like interference between said toothed crown and said counter toothing.

20. A combination according to claim 15, wherein said recovery apparatus further comprises at least one knob, said knob being adapted for operating said spool for recovering said cable by causing ratchet-like interference between said toothed crown and said counter toothing, said knob being rotatably mounted on said lever and arranged facing said rear quarter of said ski boot.

* * * * *